US008821217B2

(12) United States Patent
Ficai

(10) Patent No.: US 8,821,217 B2
(45) Date of Patent: Sep. 2, 2014

(54) ABRASIVE ANNULAR GRINDING WHEEL

(76) Inventor: Giovanni Ficai, Fraz. Ozzano Taro (IT)

( * ) Notice: Subject to any disclaimer, the term of this patent is extended or adjusted under 35 U.S.C. 154(b) by 617 days.

(21) Appl. No.: 12/929,423

(22) Filed: Jan. 24, 2011

(65) Prior Publication Data

US 2011/0212674 A1 Sep. 1, 2011

(30) Foreign Application Priority Data

Mar. 1, 2010 (IT) ..... MO10A0046

(51) Int. Cl.

| | |
|---|---|
| ***B24B 1/00*** | (2006.01) |
| ***B24D 18/00*** | (2006.01) |
| ***B24D 7/02*** | (2006.01) |
| ***B24D 7/04*** | (2006.01) |

(52) U.S. Cl.

CPC ..... *B24D 18/009* (2013.01); *B24D 7/02* (2013.01); *B24D 7/04* (2013.01)

USPC ..... 451/56; 51/297; 264/319

(58) Field of Classification Search

USPC ..... 451/56; 51/297; 264/319

See application file for complete search history.

(56) References Cited

U.S. PATENT DOCUMENTS

| | | | | |
|---|---|---|---|---|
| 2,069,116 | A * | 1/1937 | Sanford | 451/544 |
| 3,067,551 | A * | 12/1962 | Maginnis | 451/49 |
| 3,540,163 | A * | 11/1970 | Shoemaker | 451/548 |
| 3,576,090 | A * | 4/1971 | Shoemaker | 451/548 |
| 3,867,795 | A * | 2/1975 | Howard | 451/548 |
| 3,868,793 | A | 3/1975 | Corcoran et al. | |
| 3,896,593 | A * | 7/1975 | Rine | 451/548 |
| 4,910,924 | A * | 3/1990 | Bouchard et al. | 451/548 |
| 5,431,596 | A | 7/1995 | Akita et al. | |
| 5,573,453 | A * | 11/1996 | Tiefenbach, Jr. | 451/533 |
| 7,527,050 | B2 * | 5/2009 | Corcoran, Jr. | 125/15 |

FOREIGN PATENT DOCUMENTS

| | | |
|---|---|---|
| GB | 1 481 195 A | 7/1977 |

* cited by examiner

*Primary Examiner* — Maurina Rachuba

(74) *Attorney, Agent, or Firm* — Modiano & Associati; Albert Josif; Daniel J. O'Byrne

(57) ABSTRACT

A flat or center depressed abrasive grinding wheel, comprising an abrasive discoidal element which is associable, substantially coaxially, with the free end of a rotating shaft of a grinder, having at least one substantially central through hole, a first face which can be arranged, in the assembly configuration, so as to be substantially directed toward the grinder and which forms the back of the discoidal element, and a second face, which is opposite to the first face. The discoidal element comprises at least one first layer of a discoidal abrasive mix defined at the first face and at least one second layer of discoidal abrasive mix defined at least one portion of the second face. The first and second layers of abrasive mix are mutually superimposed and jointly associated. The second layer of abrasive mix has an inside diameter that is substantially larger than the diameter of the through hole.

7 Claims, 7 Drawing Sheets

ABRASIVE ANNULAR GRINDING WHEEL

BACKGROUND OF THE INVENTION

Abrasive grinding wheels of the discoidal type with depressed center or the flat type are known which have an outside diameter comprised substantially between 100 and 230 mm and are used particularly on electric or compressed-air portable grinders, also known as sanders, of the high-speed type (60-100 m/s peripheral speed), to perform dressing and/or cutting operations, and are essentially constituted by an abrasive mix reinforced by reinforcements constituted by one or more fabric nets, by one or two metallic annular elements, commonly known as washers or rings, which delimit the hole for coupling the grinding wheel to the pivot of the grinder, and by an optional label made of paper or other applied material commonly used, which adheres to one of the two faces of the grinding wheel (usually to the convex one).

The abrasive mix is constituted generally by grains of abrasive material (light green, dark green, black silicon carbide; corundums, zirconium-modified, semi-friable, red-brown, white, pink, ruby, ceramic-coated, silanized, monocrystalline corundums; sol-gel or sintered ceramic abrasives or others) having a predefined particle size (normally measured in meshes) which are mixed with resins, for example phenolic resins, liquid resins and/or powdered resins, and possibly modified with epoxy, phenoxy and/or other resins, modified with organic and/or vegetable or synthetic compounds, and other types of polyimide resin etcetera, and with additives and fillers.

The reinforcement nets are normally woven with filaments made of glass fiber, but other types of fiber might also be used, such as carbon, Kevlar or others; nets woven with a height in the order of 1.5 meters are immersed in a solution of liquid resins and solvents, wrung between pairs of rollers and dried in appropriate ovens inside which the resin dries without polymerizing, polymerization being completed in the curing oven together with the curing of the grinding wheel.

The discs of net required to reinforce the grinding wheels are obtained by die-cutting or other cutting methods from the net fabric thus impregnated with resin and dried.

The nets may optionally be pre-glued to a sheet of paper or polymeric material of low thickness and also to the labels.

The annular definition elements that delimit the coupling hole of the grinding wheel are constituted by a plate that is annular or has another shape, such as for example a square or polygonal shape, from the internal hole of which a cylindrical or non-cylindrical hollow tab extends; the plate adheres to one of the two faces of the grinding wheel, while the hollow tab enters the hole of the grinding wheel, delimiting its internal wall.

The labels are made of paper or tin foil or other synthetic material and normally are annular (however, they can have any other shape) and can occupy either the entire face of the grinding wheel or a limited area of the face to which they adhere and bear the identification and informational data of the grinding wheel.

One particular known type of high-strength abrasive grinding wheel is described in detail in patent IT 1,334,480, to which reference is made. In particular, the aim of that patent is to provide grinding wheels in which the strength of the layer or layers that determine the removal capacity of the grinding wheel is increased. The mixtures of abrasive material generally used are in fact generally medium-grain abrasive mixes (36, 30 and 24 mesh), which ensure a good abrasive power thereof and make it possible to reduce the uneven wear of the edge of said grinding wheel, which increases as the size of the grains used increases, and furthermore makes it possible to reduce the formation of tooth-like portions and the projection of splinters during use; the above cited patent proposed to use a first reinforcement net with a narrow mesh having a structuring action, immersed in a layer of fine-grain (46-60 mesh) abrasive mix arranged upstream of the layer or layers of the medium-grain abrasive mix provided in the region of contact/work of said grinding wheel. By using this refinement, described in patent IT 1,334,480, it has been observed that it is possible to further increase the particle size of the layer of abrasive material assigned to work (20, 18, 16 and even 12 mesh), with a consequent increase in the abrasive action and therefore in the removal efficiency of said grinding wheel.

However, these known types of grinding wheel are not free from drawbacks, which include the fact that the layer of abrasive mix having high removal capacity, i.e., the medium-grain mix, has very high costs with respect to fine-grain mixes, said cost affecting significantly the total cost of the grinding wheel.

This occurs especially if one uses high-performance mixes, such as mixes based on zirconium-modified corundum.

Furthermore, another drawback is caused by the fact that much of said layer of abrasive mix with high removal capacity, despite being used in providing the grinding wheel, is not used, since it is present in regions of said grinding wheel that are not functionally active.

Furthermore, an additional drawback of known types of abrasive grinding wheel consists in that said grinding wheels having a relatively large thickness with respect to their diameter have a structure that is absolutely rigid and lacks any flexibility, a fact which, in combination with the high rotation rate and imperfections in shape and balancing, causes vibrations at frequencies that are unpleasant and harmful to the upper limbs of the operator.

SUMMARY OF THE INVENTION

The aim of the present invention is to eliminate the drawbacks noted above of the background art, by providing an annular abrasive grinding wheel that allows savings in terms of waste of raw material used and in terms of total cost of the grinding wheel, with equal performance of said grinding wheel or with equal removal capacity thereof.

Within this aim, an object of the invention is to provide an abrasive grinding wheel that has an inventive feature limiting vibrations during its use, a fact which anyway is prescribed by currently applicable statutory provisions.

Another object of the present invention is to have a structure that is simple, relatively easy to provide in practice, safe to use, effective in operation and has relatively low costs.

This aim and these and other objects which will become better apparent hereinafter are achieved by the present abrasive flat or grinding wheel or grinding wheel with depressed center, which comprises an abrasive discoidal element that can be associated, substantially coaxially, with the free air end of a rotating shaft of a grinder, comprising at least one substantially central through hole, a first face which can be arranged—in the assembly configuration—so that it is substantially directed toward said machine and defines the back of said discoidal element, and a second face which is opposite to said first face, said discoidal element comprising at least one first layer of a discoidal abrasive mix defined at said first face and at least one second layer of discoidal abrasive mix which is defined at least one portion of said second face, said first and second layers of abrasive mix being mutually superimposed and jointly associated, characterized in that said second layer of abrasive mix comprises an inside diameter that is substantially larger than the diameter of said through hole.

BRIEF DESCRIPTION OF THE DRAWINGS

Further characteristics and advantages of the present invention will become better apparent from the following detailed description of a preferred but not exclusive embodiment of an annular abrasive grinding wheel, illustrated by way of non-limiting example in the accompanying drawings, wherein.

DESCRIPTION OF THE PREFERRED EMBODIMENTS

Figure 1:
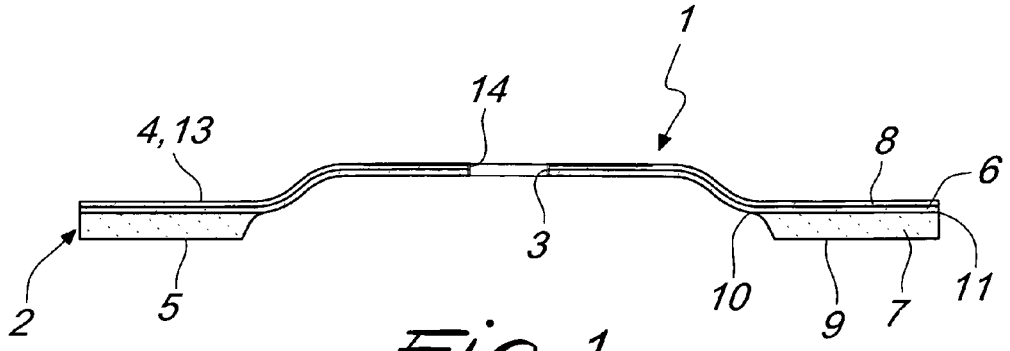
FIG. 1 is a schematic side elevation view of a grinding wheel with depressed center according to the invention.
Figure 2:
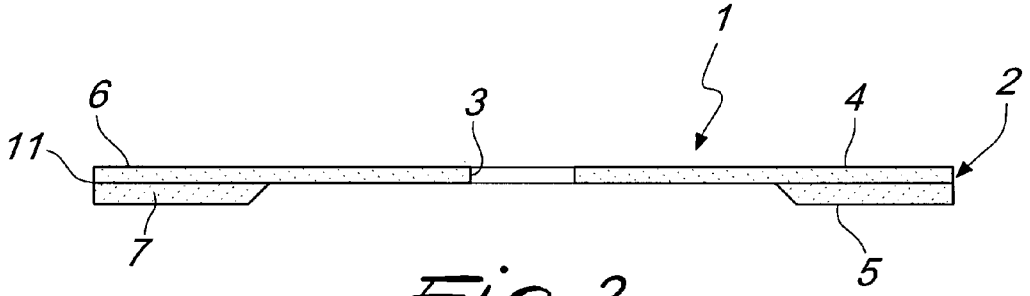
FIG. 2 is a schematic side elevation view of a flat grinding wheel according to the invention.

With reference to the figures, the reference numeral 1 generally designates an abrasive grinding wheel with depressed center, for example of the shape of a Chinese hat, conical or cambered or the like or a flat grinding wheel.

The grinding wheel 1 comprises an abrasive discoidal element 2, which can be joined or associated, so that it is substantially coaxial, with the free end of a rotating shaft of a grinder.

The discoidal element 2 comprises at least one substantially central through hole 3 and a first face 4 which can be arranged—in the assembly configuration—so that it is substantially directed toward the grinder and defines the back of said discoidal element.

The discoidal element 2 furthermore comprises a second face 5 that lies opposite the first face 4.

In particular, the discoidal element 2 comprises at least one first layer 6 made of an abrasive mix, which also has a substantially discoidal shape and is defined at the first face 4, and at least one second layer 7 of abrasive mix, which is substantially discoidal and is defined at least one portion of the second face 5, about the central through hole.

The first layer and the second layer, respectively 6 and 7, of abrasive mix are mutually superimposed and jointly associated.

In particular, for the purposes of the present invention, the second layer 7 of abrasive mix comprises an inside diameter that is substantially larger than the diameter of the through hole 3.

Advantageously, the second layer 7 of abrasive mix is substantially annular and extends from the peripheral edge 11 of such grinding wheel.

The outside diameter of the second layer 7 of abrasive mix is substantially equal to the outside diameter of the first layer 6 of abrasive mix (with the usually applicable tolerances), whereas the inside diameter of the second layer 7 of mix is substantially approximately equal to two thirds of the outside diameter of said second layer.

This is because it has been found that such annular region occupied by the second layer 7 of abrasive mix is the portion of the grinding wheel 1 that is generally used; when the diameter of said grinding wheel, due to wear caused by use, decreases to a value that is less than two thirds of the initial outside diameter, its performance in fact deteriorates rapidly due to the reduced peripheral speed and due to the difficulty for the operator to control the lateral oscillation of the machine.

Advantageously, the abrasive mix of the first layer 6 of abrasive mix has a finer particle size than the abrasive mix of the second layer 7 of abrasive mix.

The fine abrasive mix of the first layer 6 of abrasive mix in fact has a particle size substantially comprised between 120 and 46 mesh (however, the use of abrasive mixes with a particle size that is larger or smaller than the range given, depending on the requirements, is not excluded) and, the coarse abrasive mix of the second layer 7 of abrasive mix has a particle size comprised substantially between 24 and 12 mesh (however, the use of abrasive mixes mixes with a particle size that is larger or smaller than the range given, depending on the requirements, is not excluded).

Advantageously, the coarse particle size up to 12 mesh and beyond of the second layer 7 of abrasive mix allows a high abrasive action of the grinding wheel 1, which is supported by the reinforcement action of the first layer 6 of abrasive mix, whose only task is to support such second layer, when stressed.

The first layer 6 of abrasive mix can have a thickness that is lower than that of the second layer 7 of abrasive mix and is generally lower than or equal to about 3 mm, although it might also be higher or lower than 3 mm depending on the requirements.

The grinding wheel 1 comprises at least one first reinforcement net 8 and at least one second reinforcement net 9, which are respectively embedded in the first layer 6 of abrasive mix and in the second layer 7 of abrasive mix.

The first reinforcement net 8 and the second reinforcement net 9 are substantially coplanar at least with the first face 4 of the discoidal element 2.

Advantageously, the grinding wheel 1 comprises at least one auxiliary reinforcement net 10, which is interposed between the first layer 6 of abrasive mix and the second layer 7 of abrasive mix, which is at least partially embedded therein to improve mechanical strength.

The auxiliary reinforcement net 10 is substantially annular and extends from the peripheral edge 11 of such grinding wheel to the inner peripheral edge of the through hole 3, for example concentrically with respect to such through hole.

The auxiliary net 10, of the most convenient size and types, has for example larger meshes than the first reinforcement net 8, for the safe adhesion of the second layer 7 of abrasive mix to the first layer 6 of abrasive mix, and allows better at least partial interpenetration of such layers.

On the first face 4, i.e., the back of the grinding wheel 1, it is possible to arrange a label 13 made of paper or tin foil or other similar applied material, whereas a plurality of second layers 7 of abrasive mix and a plurality of respective second reinforcement nets 9 can be alternated and superimposed on the second layer 7 of abrasive mix until the desired thickness of the grinding wheel 1 is achieved.

The abrasive mixes of the first layer and of the second layer or layers of abrasive mix, respectively 6 and 7, as well as the first reinforcement net and the second reinforcement net or nets, respectively 8 and 9, and the label 13, are of a type that is conventionally known in the field.

Furthermore, the label 13 can be applied once the grinding wheel 1 has been fired/polymerized, by adhesive bonding thereof or by the application of self-adhesive labels, by screen printing, tampographic printing, spraying or in another form of paint through stencils.

Advantageously, by choosing appropriately the ratio between the size of the grains of the abrasive mix used, which depends on the intended use of said grinding wheel, and the aperture of the meshes of the nets, it is possible to optimize the penetration of the mix through the meshes of such nets.

Finally, the grinding wheel 1 comprises one or more metallic annular elements, commonly known as washers 14 or rings, which delimit the hole for coupling the grinding wheel to the pivot of the grinding machine.

The method for producing, by using a mold 100, the present grinding wheel 1 according to the invention is as follows.

First of all, the method comprises the step of providing at least one core 101 for forming the through hole 3 for the coupling of a grinding wheel 1, which is centered in the forming cavity 102 of the female part 103 of a mold 100.

The figures show, merely by way of example, two embodiments of a mold 100 for manufacturing discoidal grinding wheels of the type with depressed center or the flat type, where this does not constitute a limiting constraint on the embodiment of the present invention.

The core 101 rises from the bottom 104 of the cavity 102 (whose height is adjustable) and is constituted by a pivot for forming the through hole 3 of the grinding wheel 1.

For forming grinding wheels with depressed center, at the center of the bottom 104 there is a concave recess 105 for forming the depressed center of the grinding wheel 1, in the through hole of which the core 101 slides.

The punch 106 (the male part of the mold 100) has, on its pressing surface, a protrusion 107, which cooperates with the recess 105 to define the shape of the depressed center. A hollow 108 is provided at the center of the punch 106 and the core 101, designed to be fitted on such punch, is inserted therein during pressing.

The mold 100 comprises, in particular, at least one separation surface 109, which is associated with at least one of the punch 106 and the bottom 104 of such mold, arranged in an annular region that is intermediate between the region of accommodation of the forming core 101 and the perimetric edge of the jacket 110 of such mold.

The separation surface 109 is, for example, a step that is defined in at least one of the punch 106 and the bottom 104 of such mold.

The riser of the step is inclined at an inclination angle comprised between 40° and 60°; different embodiments of the separation surface 109, according to necessity, are not excluded.

The method of forming the grinding wheel 1 comprises the step of depositing at least one of the first layer 6 of at least one abrasive mix and at least the second layer 7 of at least one abrasive mix.

Furthermore, the method comprises the step of depositing the other one of the second layer 7 of abrasive mix and the first layer 6 of abrasive mix.

In particular, the step of depositing the second layer 7 of abrasive mix is carried out by arranging said second layer in the mold 100, in the region interposed between the separation surface 109 and the perimetric edge of the jacket 110 of such mold.

Finally, the method according to the invention comprises the step of closing the mold 100, by means of the punch 106, in order to press and compress at least the first and second layer, respectively 6 and 7, of abrasive mix.

Furthermore, the method according to the invention comprises the steps of arranging, respectively at the first layer 6 and at the second layer 7, respective first reinforcement nets 8 and second reinforcement nets 9, which are designed to be embedded in the abrasive mix, and the step of interposing between at least the first and second layers, respectively 6 and 7, of abrasive material at least the auxiliary net 10, which covers the entire surface of the first layer 6 of abrasive material.

Figure 3:
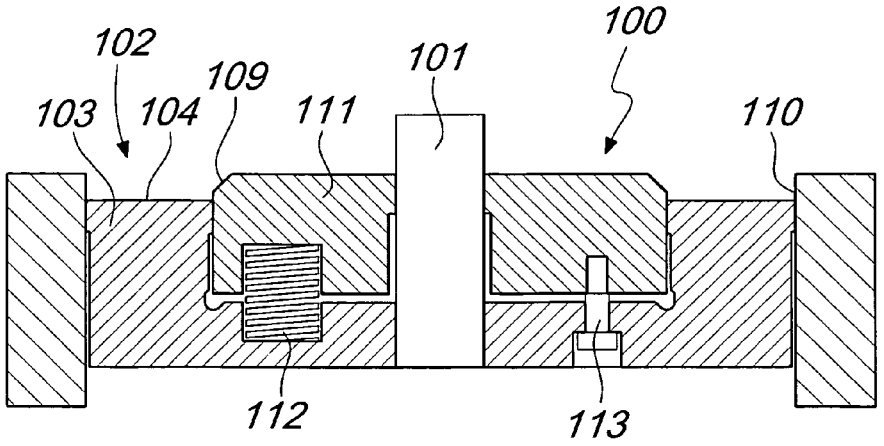
FIG. 3 is a sectional side view of a female part of a mold for forming grinding wheels according to the invention.
Figure 4:
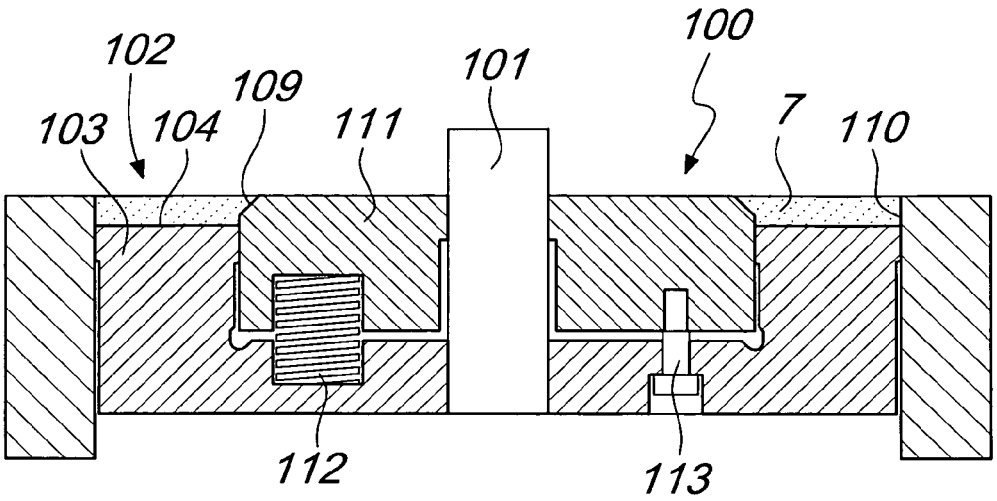
FIG. 4 is a view of FIG. 3 with a second layer of abrasive mix deposited.
Figure 5:
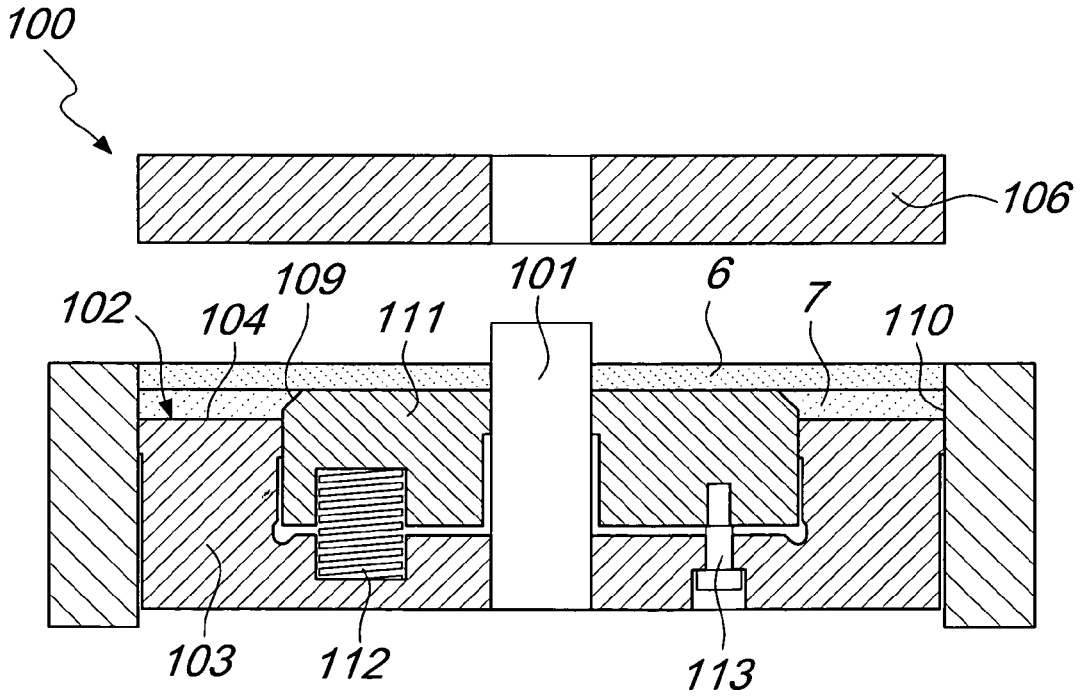
FIG. 5 is a sectional view of the mold of FIG. 3 in the open condition, with a first layer and a second layer of abrasive mix deposited.
Figure 6:
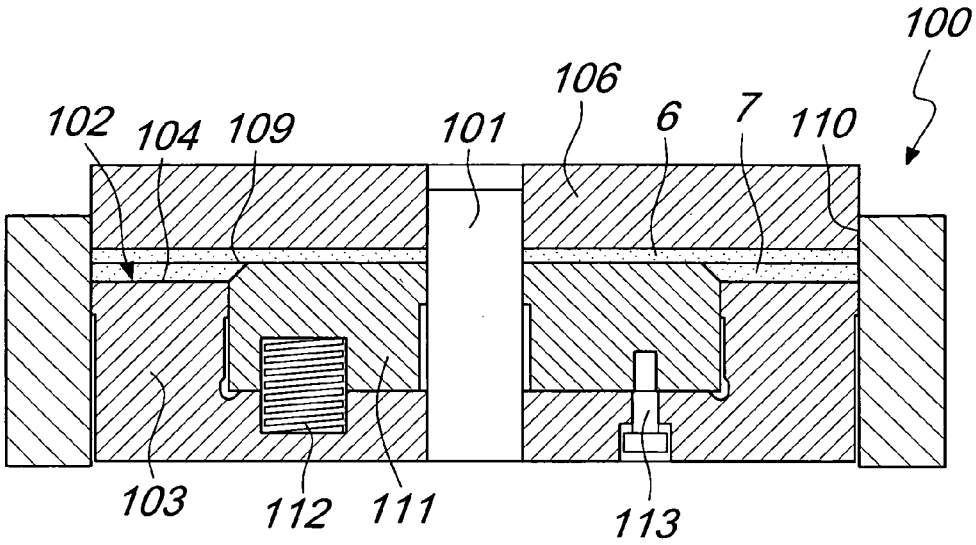
FIG. 6 is a view of FIG. 5 with the mold closed.
Figure 7:
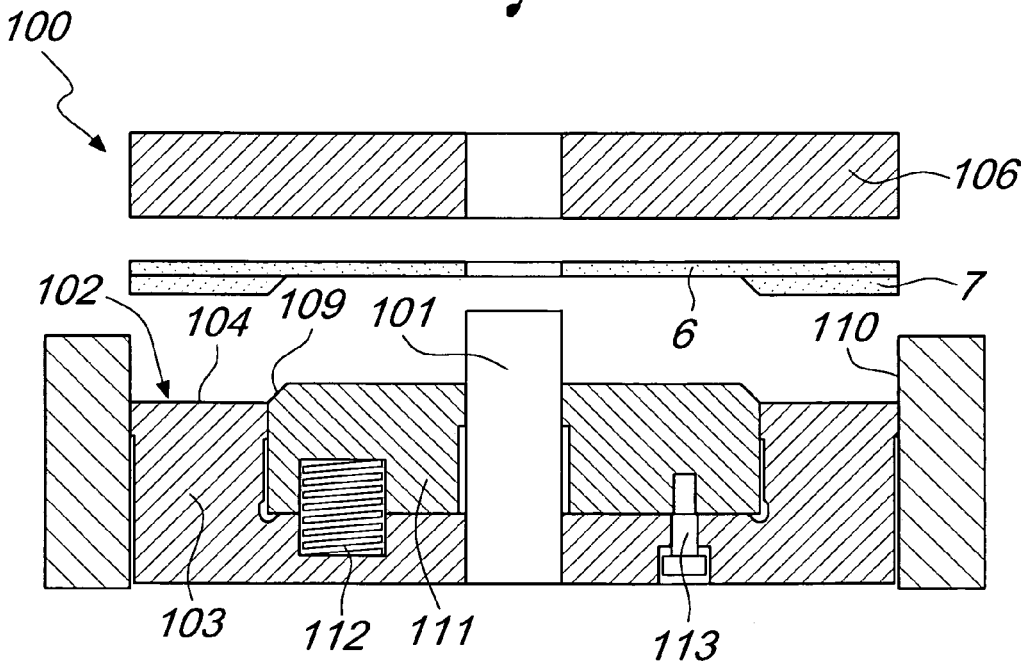
FIG. 7 is a view of FIG. 5 with the mold open and with the formed grinding wheel in exploded view.

In the first embodiment, shown in FIGS. 3 to 7, the mold 1 comprises a raised portion 111 of the bottom 104, which is associated so that it can slide with respect to the core 101 and defines an annular step that surrounds such core.

The lateral surface of the raised portion 111 substantially defines the separation surface 109.

Elastic pusher means 112, for example of the type of a compression spring, are interposed between the raised portion 111 and the bottom 104 so as to push the raised portion 111 toward the punch 106.

Furthermore, abutment means 113 are provided between the raised portion 111 and the female part 103 and/or the bottom 104 of the mold 100 so as to determine the limit of the stroke, for example the stroke toward the punch 106, of such raised portion.

The surface of the bottom 104 that is peripheral with respect to the raised portion 111 defines the resting surface of the second layer 7 of abrasive mix at the second face 5; the central surface of the raised portion 111 instead defines the resting surface of the first layer 6 of abrasive mix that defines the remaining portion of the second face 5.

In this embodiment, the forming method provides for depositing the second layer 7, flush with the raised portion 111, prior to the step of depositing the first layer 6.

Under the pressure applied by the punch 106, the raised portion 111 yields, in contrast with the elastic pusher means 112, for the substantially uniform pressing of said first and second layers.

If the protrusion 107 and the recess 105 for shaping grinding wheels with depressed centers are not present in the mold 100, it is possible to provide for the use of contoured structures 114 that are designed to be interposed between a plurality of grinding wheels in a pack configuration, in order to form the depressed center after the pressing of the grinding wheels, for example by cold or hot bending thereof during firing.

Figure 8:
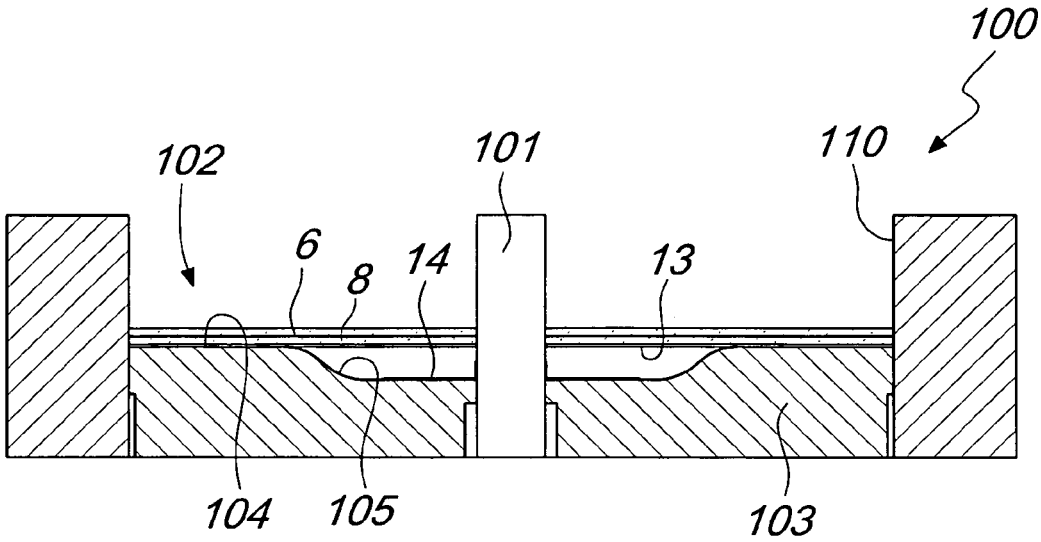
FIG. 8 is a sectional side view of an alternative embodiment of a female part of a mold for forming grinding wheels according to the invention, with a first layer of abrasive mix deposited.
Figure 9:
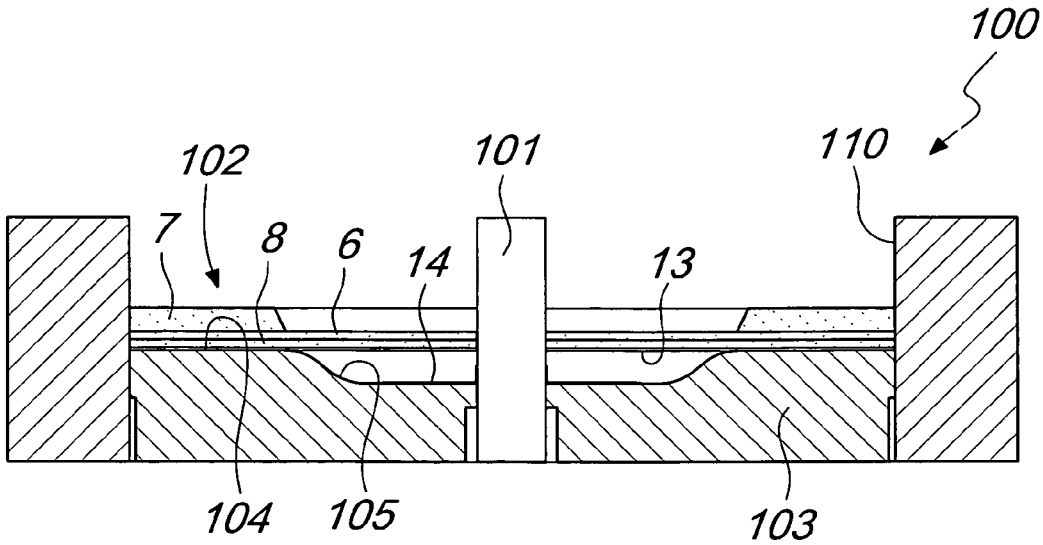
FIG. 9 is a view of FIG. 8 with a first layer and a second layer of abrasive mix deposited.
Figure 10:
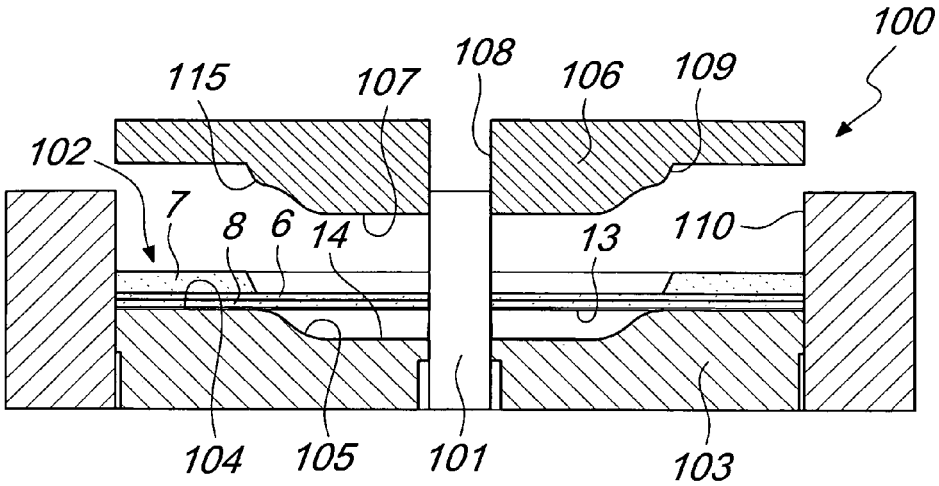
FIG. 10 is a sectional view of the mold of FIG. 8 in the open condition, with a first layer and a second layer of abrasive mix deposited.
Figure 11:
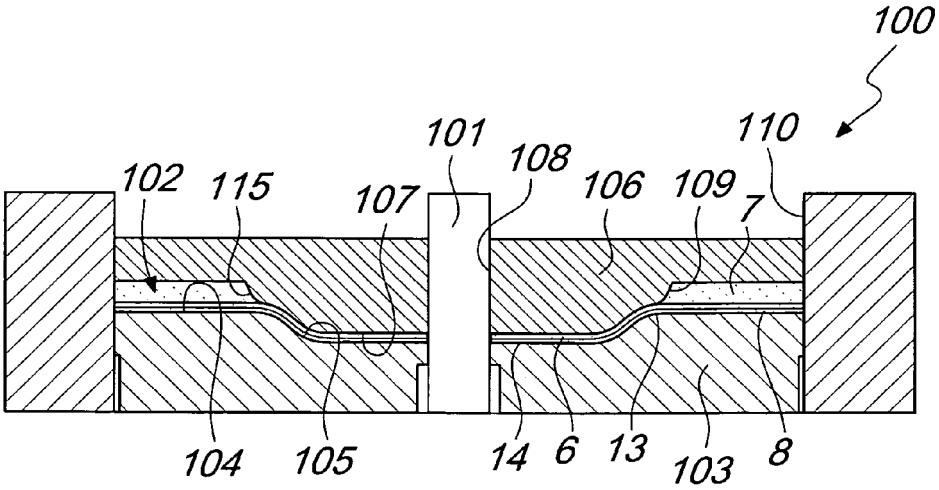
FIG. 11 is a view of FIG. 10 with the mold closed.
Figure 12:
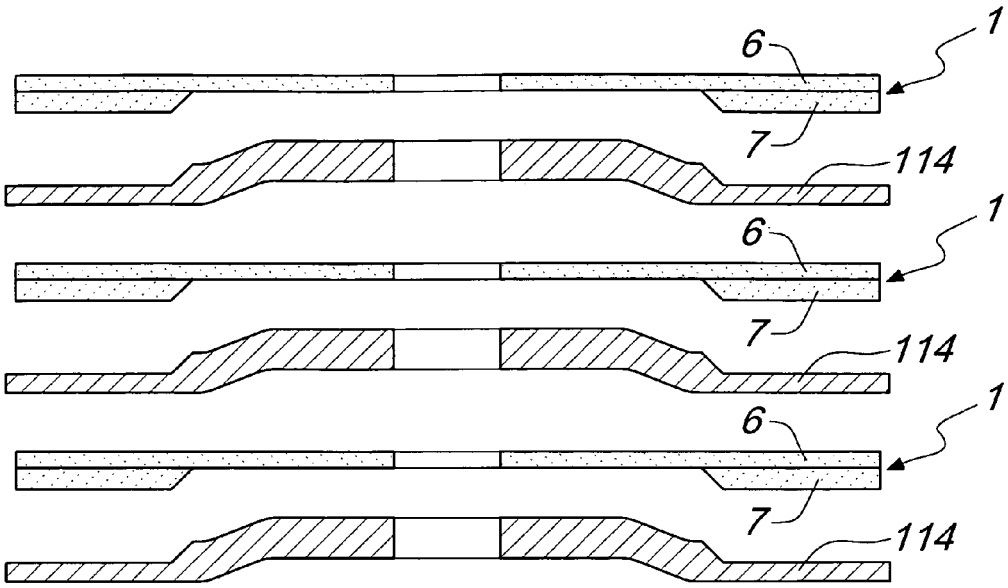
FIG. 12 is an exploded sectional side view of a pack of grinding wheels designed to be of the type with depressed center, in the state to be fired.
Figure 13:
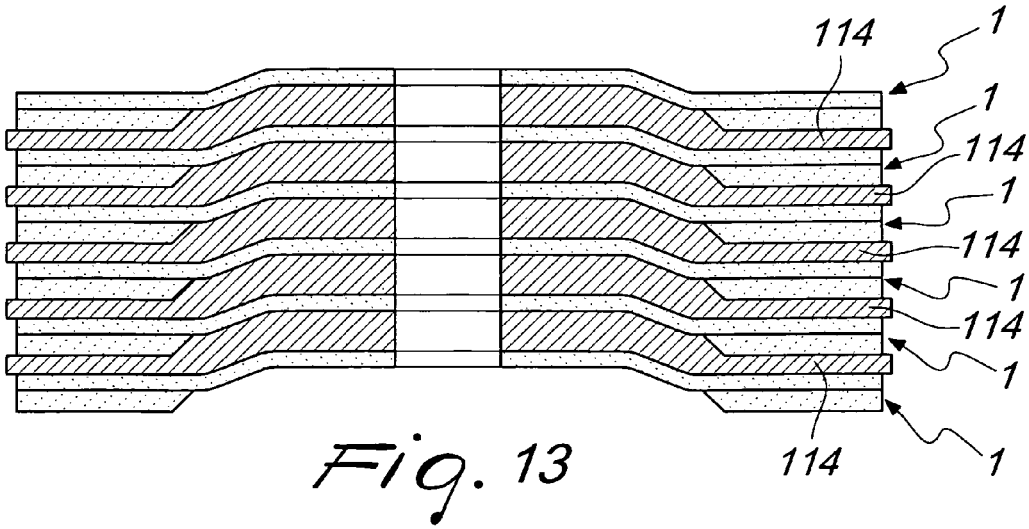
FIG. 13 is a sectional side view of the pack of grinding wheels of FIG. 12.
Figure 14:
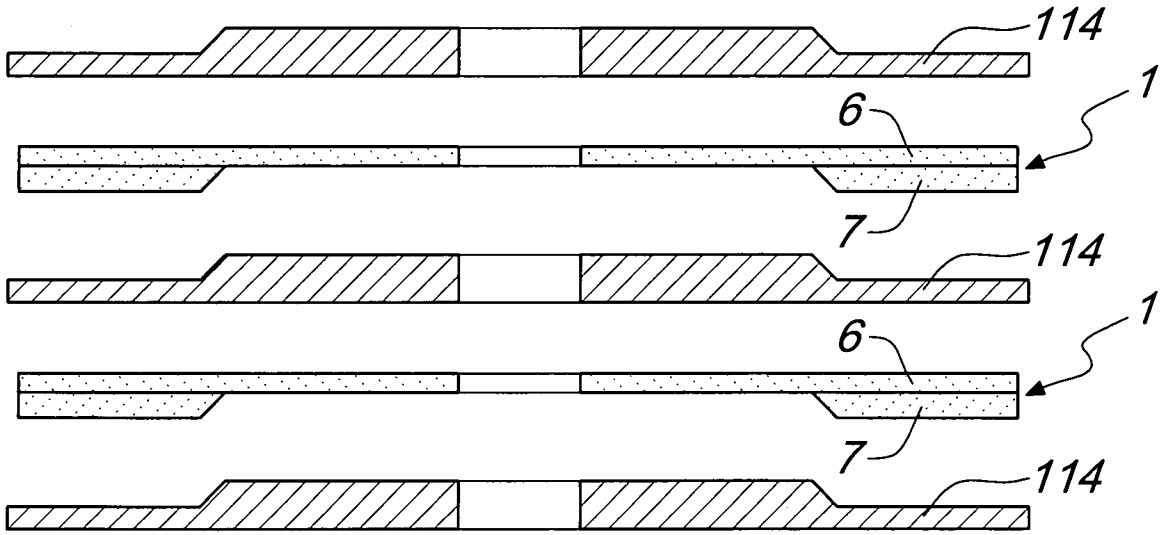
FIG. 14 is a sectional exploded side view of a pack of flat grinding wheels to be fired.

In the second embodiment, shown in FIGS. 8 to 11, the mold 100 comprises a protrusion 115 that is defined on the punch 106 and is for example substantially cylindrical with a diameter substantially larger than the diameter of the protrusion 107 which in turn is defined on such protrusion. The side walls of the protrusion 115 define the separation surface 109.

The second layer 7 of abrasive mix is such that it is interposed, for example pressed and compressed beforehand, once the mold 100 has been closed, in the annular region defined between the bottom 104, the annular punch portion 106 that is peripherally external to the protrusion 115, the separation surface 109 and the jacket 110 of the female part 103.

In this embodiment, the forming method provides for depositing the first layer 6 prior to the step of depositing the second layer 7.

However, the grinding wheel 1 might be provided by means of two separate molds, one for compacting the first layer 6 of abrasive mix and the other for providing by compaction the second layer 7 of abrasive mix; the grinding wheel 1 is then completed by means of the adhesion due to pressing of the two layers and by firing.

Advantageously, the bottom 104 and/or the punch 106 (at its pressing face) can be shaped to provide smooth or studded surfaces in the most disparate shapes on the first and/or second faces, respectively 4 and 5, of the grinding wheel 1.

In practice it has been found that the described invention achieves the proposed aim and objects, and in particular the fact is stressed that the annular abrasive grinding wheel according to the invention allows savings in terms of waste of raw material used and provides unquestionable savings on the total cost of the grinding wheel, with equal performance of said grinding wheel, i.e., with equal removal capacity thereof.

Furthermore, it has been found that thanks to the reduction in thickness of at least the central portion of the grinding wheel, said wheel is less rigid and has a very substantial capacity to absorb vibrations during use, providing a user comfort that until now has not been available with grinding wheels commonly known today.

Moreover, the grinding wheel according to the invention has a structure that is simple and relatively easy to provide in practice, safe to use and effective in operation as well as relatively inexpensive.

The invention thus conceived is susceptible of numerous modifications and variations, all of which are within the scope of the appended claims.

All the details may furthermore be replaced with other technically equivalent elements.

In practice, the materials used, as well as the contingent shapes and dimensions, may be any according to requirements without thereby abandoning the protective scope of the appended claims.

The disclosures in Italian Patent Application No. MO2010A000046 from which this application claims priority are incorporated herein by reference.

What is claimed is:

1. A method for the production in a mold of an annular abrasive grinding wheel having a depressed center with various shapes or a flat shape, for grinders, which comprises the steps of:

providing at least one core for forming a through hole for coupling of the grinding wheel centered in a forming cavity of a female part of a mold;

depositing, in said mold, at least one of a first layer of at least one abrasive mix and of at least one second layer of at least one abrasive mix;

depositing, in said mold, a further one of said second layer of abrasive mix and of said first layer of abrasive mix;

closing the mold, by means of a punch, and press and compact said at least one first and second layers of abrasive mix;

wherein the step of depositing said second layer of abrasive mix is performed by arranging said second layer of abrasive mix in said mold that has at least one separation surface associated with at least one of the punch and a bottom of the mold in an annular zone intermediate between a region for accommodating said forming core and a perimetric edge of a jacket of the mold, in a zone interposed between said separation surface and the perimetric edge of the jacket of the mold, said separation surface being a step that is defined in at least one of the punch and the bottom of said mold, said mold being provided to comprise a raised portion of said bottom or a protrusion on said punch which form said step separation surface, and wherein, said step for pressing and compacting said at least one first and second layers of abrasive mix, comprises sliding said raised portion or protrusion on said core.

2. The method of claim 1, wherein the abrasive mix of said first layer of abrasive mix is provided having a finer particle size than the abrasive mix of said second layer of abrasive mix.

3. The method of claim 1, comprising the step of interposing between said at least one first and second layers of abrasive material, at least one auxiliary reinforcement net, arranged so as to cover an entire surface of said first layer of abrasive material.

4. The method of claim 1, comprising providing elastic pusher means interposed between said raised portion and the female part or bottom of the mold that push said raised portion toward the punch in said pressing and compacting step.

5. The method of claim 1, comprising depositing said at least one second layer of abrasive mix in said mold prior to the deposition of said first layer of abrasive mix.

6. The method of claim 1, comprising depositing said at least one first layer of abrasive mix in said mold prior to the deposition of said second layer of abrasive mix.

7. The method of claim 6, comprising depositing said at least one second layer of abrasive mix interposed, pressed and compressed beforehand, once the mold has been closed in said mold closing step.

* * * * *